US005137467A

United States Patent [19]

Arai

[11] Patent Number: 5,137,467

[45] Date of Patent: Aug. 11, 1992

[54] MULTIPOLE ELCTRICAL CONNECTOR

[75] Inventor: Tatsuya Arai, Tokyo, Japan

[73] Assignee: Hirose Electric Co., Ltd., Tokyo, Japan

[21] Appl. No.: 753,378

[22] Filed: Aug. 30, 1991

[30] Foreign Application Priority Data

Sep. 17, 1990 [JP] Japan ..... 2-96513[U]

[51] Int. Cl.[5] ..... H01R 13/64

[52] U.S. Cl. ..... 439/374; 439/680

[58] Field of Search ..... 439/374, 378, 248, 699, 439/680

[56] References Cited

U.S. PATENT DOCUMENTS 4,812,133 3/1989 Flear et al. ..... 439/248

FOREIGN PATENT DOCUMENTS 2618265 1/1989 France ..... 439/374

*Primary Examiner*—Eugene F. Desmond

*Attorney, Agent, or Firm*—Kanesaka & Takeuchi

[57] ABSTRACT

A super multipole electrical connector consisting of a male connector (2) and a female connector (3). The male connector includes a housing (4) having a fitting cavity opening (5) on a front side (4*a*) thereof and at least one terminal unit receiving recess (11) on a rear side thereof; a terminal plate (22); a plurality of terminals (24, 25, 26) planted on the terminal plate to form a terminal unit (21); the terminal unit being fitted in the receiving recess and secured to the housing to form a super multipole electrical connector; and a pair of foolproof sections (17, 18) formed on opposite sides of the housing. The foolproof sections each includes a guide portion (19) raised from the front side of the housing; a foolproof recess (20) extending rearwardly from the guide portion and having an expanded arcking mouth portion (20*a*) at a front end thereof, the arcking mouth poriton having a outwardly sloped side wall, and a tapered section (20*b*) extending rearwardly from the mouth portion. The female connector includes a housing having (30) a pair of guide recesses (49, 50) on opposite sides thereof for receiving the guide portions and a pair of guide projections (51, 52) extending forwardly from the guide recesses for fitting into the foolproof recesses.

1 Claim, 14 Drawing Sheets

MULTIPOLE ELCTRICAL CONNECTOR

BACKGROUND OF THE INVENTION

1. Field of the Invention

The present invention relates generally to two-piece electrical connectors for connecting two circuit boards and, more particularly, to a two-piece electrical connector having a large number of terminals.

2. Description of the Prior Art

The mounting density of circuit boards increases as the integration density of semiconductor devices increases. For example, the number of terminals of a conventional LSI package has been about 100, but now it is 400 or more. As a result, the number of terminals to be connected across circuit boards is increased to 200 or more.

Components are mounted on a circuit board with the aid of flux and solder. In order to avoid problems with the movement of fluxed contacts, the stand-off of a connector above the circuit board has been increased or a chemical treatment has been applied to terminals to prevent the flux from flowing along the terminals. However, since the terminals are press fitted into the housing, there can be spaces around the terminals so that the flux can flow along the terminal or the space and deposit on the terminal contact, causing poor contact. Especially, multipole connectors of the press fit type require washing upon soldering in order to prevent any problems with the shift of fluxed contacts, thus presenting an economical problem.

As for conventional connectors having up to about 100 terminals, it has been proposed to shield the circuit board and the terminal contacts so that no flux flows into them. However, they have only two rows of terminals and present little or no problem for integral molding by which all of the terminals are molded in the housing at once. There is demand for super multipole connecters which have three or more rows of terminals. Such super multipole connectors require a fitting guide and a device for preventing damage to the connector which arises from an oblique pulling out operation. However, so far there are no super multipole connectors on the market because of lack of the manufacturing technology.

SUMMARY OF THE INVENTION

Accordingly, it is an object of the invention to provide a super multipole electrical connector having a low plugged-in height.

It is another object of the invention to provide a super multipole electrical connector having a provision for preventing damage to the electrical connector otherwise caused by forcible oblique unplugging operations.

According to the invention there is provided a super multipole electrical connector consisting of a male connector and a female connector. The male connector includes a housing having a fitting cavity opening on a front side thereof and at least one terminal unit receiving recess on a rear side thereof; a terminal plate; a plurality of terminals planted on the terminal plate to form a terminal unit; the terminal unit being fitted in the receiving recess and secured to the housing to form a super multipole electrical connector; and a pair of foolproof sections formed on opposite sides of the housing. The foolproof sections each include a guide portion raised from the front side of the housing; a foolproof recess extending rearwardly from the guide portion and having an expanded arcing mouth portion at a front end thereof, the arcing mouth portion having a outwardly sloped side wall, and a tapered section extending rearwardly from the mouth portion. The female connector includes a housing having a pair of guide recesses on opposite sides thereof for receiving the guide portions and a pair of guide projections extending forwardly from the guide recesses for fitting into the foolproof recesses.

When one connector is plugged into the other, the guide projection is fitted into the foolproof recess while the guide portion is fitted in the guide recess, with the sloped portion abutting on the tapered wall. Since the guide portion is fitted in the guide recess, the height of the connector is minimized.

When one connector is unplugged in an oblique direction, one guide projection is pulled out of the corresponding foolproof recess, but the other guide projection slides on first the tapered wall, then the arcing tapered wall, thereby preventing damage to the connector by forcible unplugging operation.

The above and other objects, features, and advantages of the invention will be more apparent from the following description when taken in conjunction with the accompanying drawings.

DESCRIPTION OF THE PREFERRED EMBODIMENT

Figure 1:
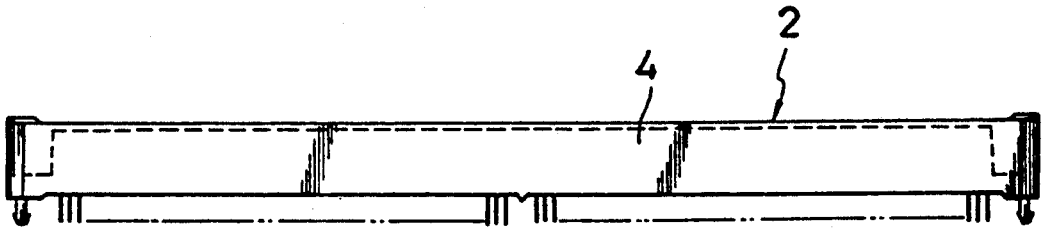
FIG. 1 is a top plan view of a male connector according to an embodiment of the invention.
Figure 2:
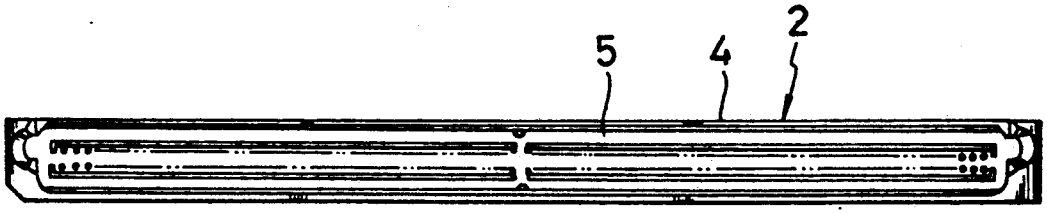
FIG. 2 is a front view of the male connector.
Figure 3:
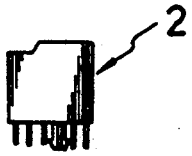
FIG. 3 is a side view of the male connector.
Figure 4:
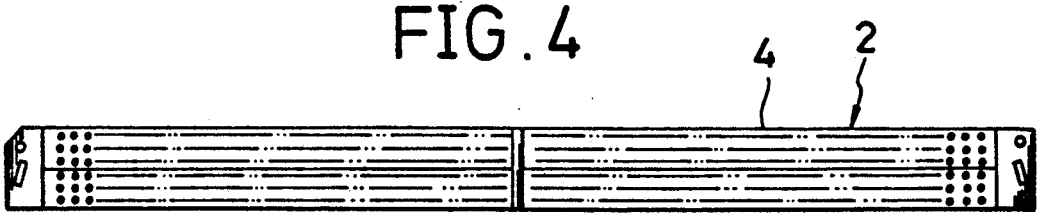
FIG. 4 is a rear view of the male connector.
Figure 5:
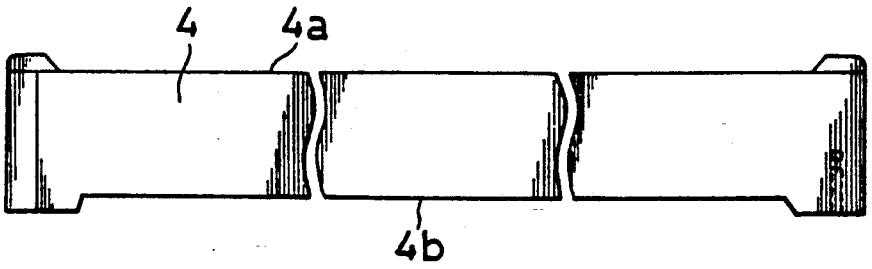
FIG. 5 is a top plan view of a housing of the male connector.
Figure 6:
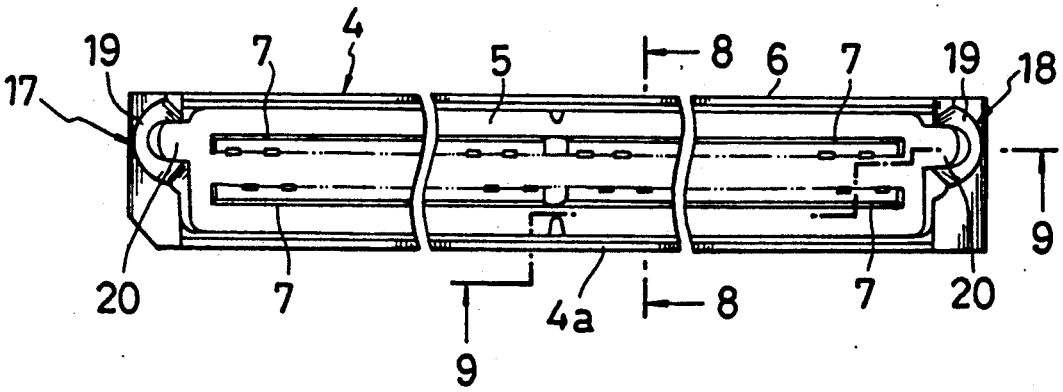
FIG. 6 is a front view of the housing.
Figure 7:
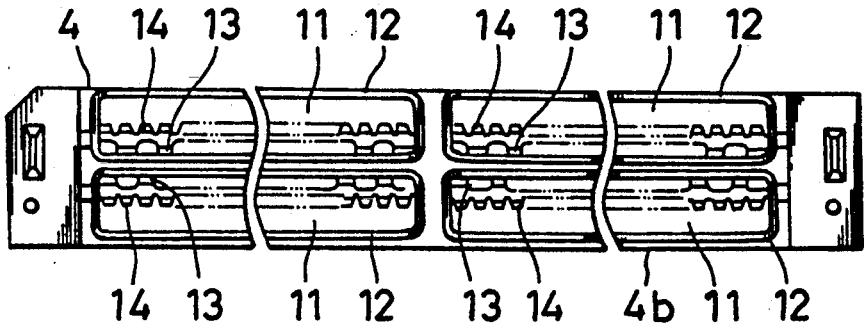
FIG. 7 is a rear view of the housing.
Figure 8:
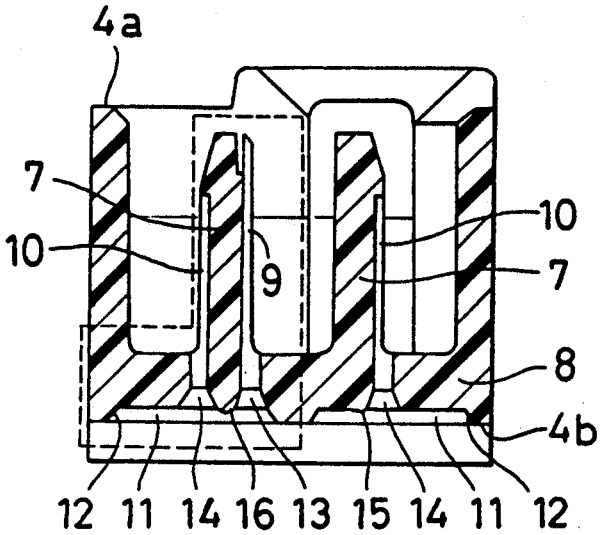
FIG. 8 is a sectional view taken along line 8—8 of FIG. 6.
Figure 9:
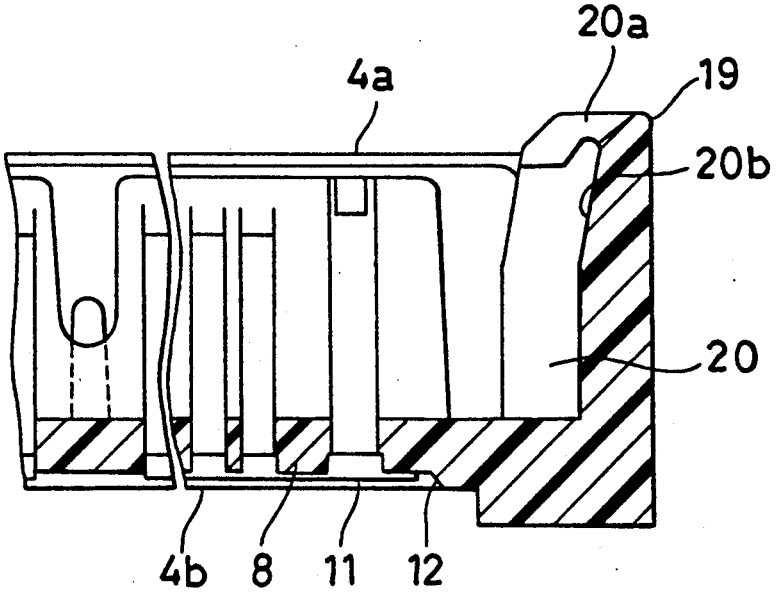
FIG. 9 is a sectional view taken along line 9—9 of FIG. 6.
Figure 10:
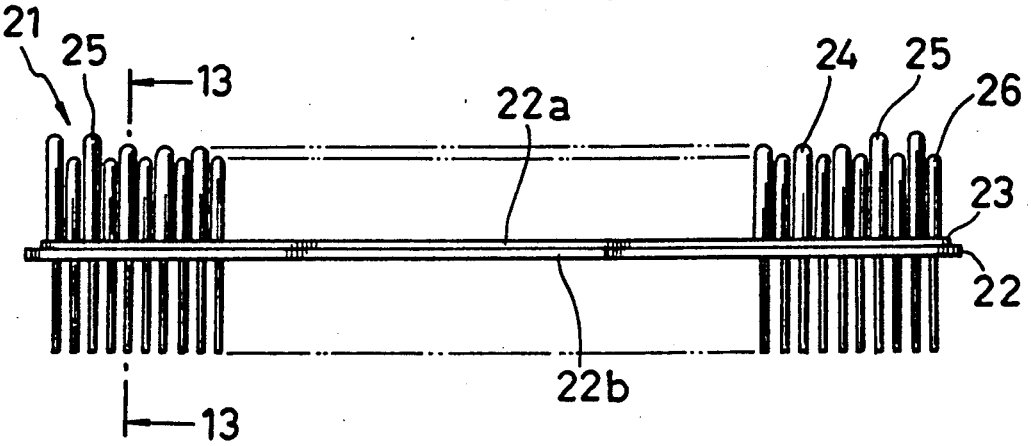
FIG. 10 is a top plan view of a terminal unit according to an embodiment of the invention.
Figure 11:
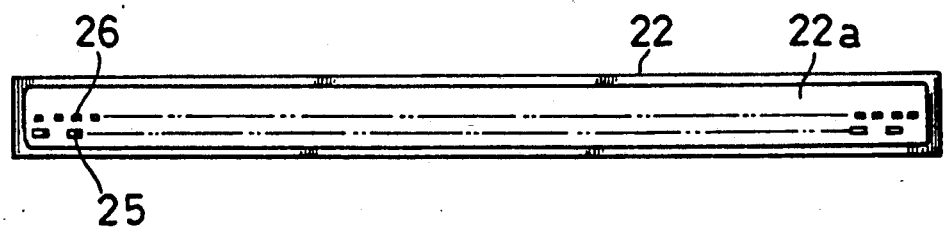
FIG. 11 is a front view of the terminal unit.
Figure 12:
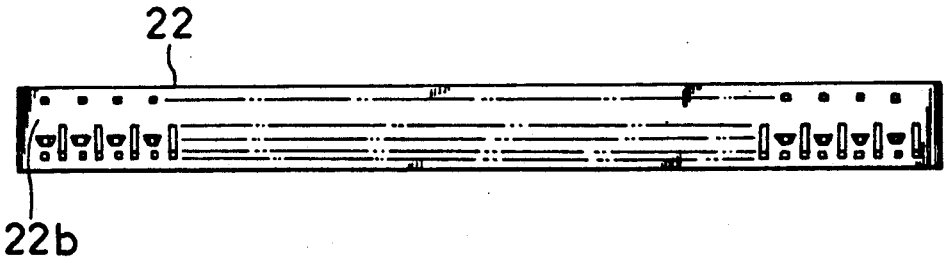
FIG. 12 is a rear view of the terminal unit.
Figure 13:
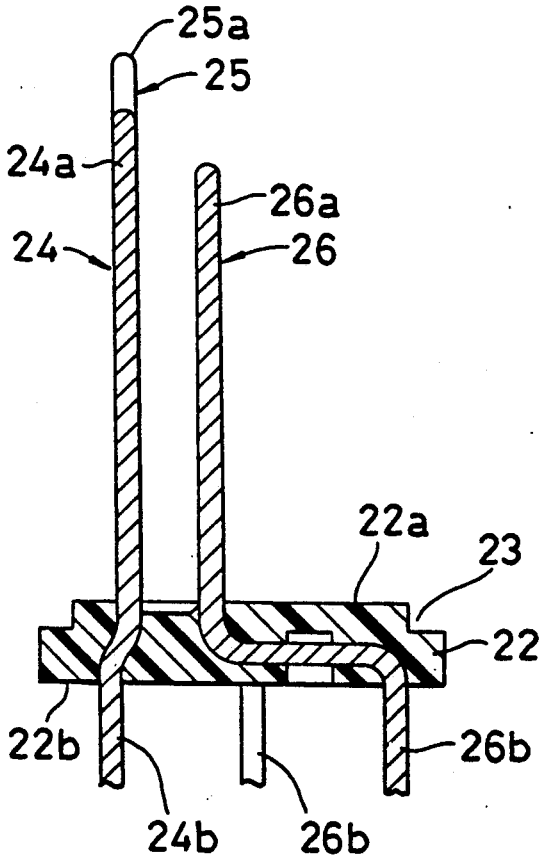
FIG. 13 is a sectional view taken along line 13—13 of FIG. 10.

In FIGS. 1–4, a male connector 2 of the straight DIP type includes a rectangular housing 4 made from a synthetic resin.

In FIGS. 5–9, the housing 4 has a rectangular fitting cavity 5 on its front side 4a surrounded by a side wall 6. Two pairs of insulation plates 7 extend forwardly from the bottom 8 of the fitting cavity 5. A number of power terminal receiving channels 9 are formed on the inside of each insulation plate 7 at a predetermined pitch while a number of signal terminal receiving channels 10 are formed on the outside of each insulation plate 7 at a half of the predetermined pitch.

Two pairs of rectangular terminal plate receiving recesses 11 are formed on the rear side 4b of the housing 4, thus dividing the rear side 4b into four areas. Each receiving recess 11 has an outwardly sloped wall 12. Terminal apertures 13 and 14 are formed on the receiving recess 11 so as to communicate with the receiving channels 9 and 10, respectively. Ridges 15 and 16 are formed on the receiving recess 11 at positions corresponding to the insulation plates 7.

A pair of foolproof sections 17 and 18 are formed on opposite sides of the front face 4a for preventing insertion errors. The foolproof section 17 or 18 has a guiding portion 19 raised from the front face 4a and a foolproof recess 20 aligned with the extension line of the upper insulation plates 7. The foolproof recess 20 has an expanded arcing mouth 20a and a tapered side wall 20b extending rearwardly from the arcking mouth 20a.

In FIGS. 10–13, a terminal unit 21 includes a rectangular terminal plate 22 which is to be fitted in the terminal plate receiving recess 11. A stepped-up portion 23 is formed on the front side 22a of the terminal plate 22. A row of power terminals 24 are planted on the terminal plate 22 by integral molding at a predetermined pitch. A pair of the power terminals on opposite sides are used as ground terminals 25. A row of signal terminals 26 are planted on the terminal plate 22 by integral molding at a half of the predetermined pitch. Terminal sections 24a, 25a, and 26a and connection sections 24b, 25b, and 26b of the power terminals 24, ground terminals 25, and signal terminals 26 project forwardly from the front side 22a and rearwardly from the back side 22b of the insulation plate 22, respectively. The terminal unit 21 is incorporated into the housing 4.

Figure 14:
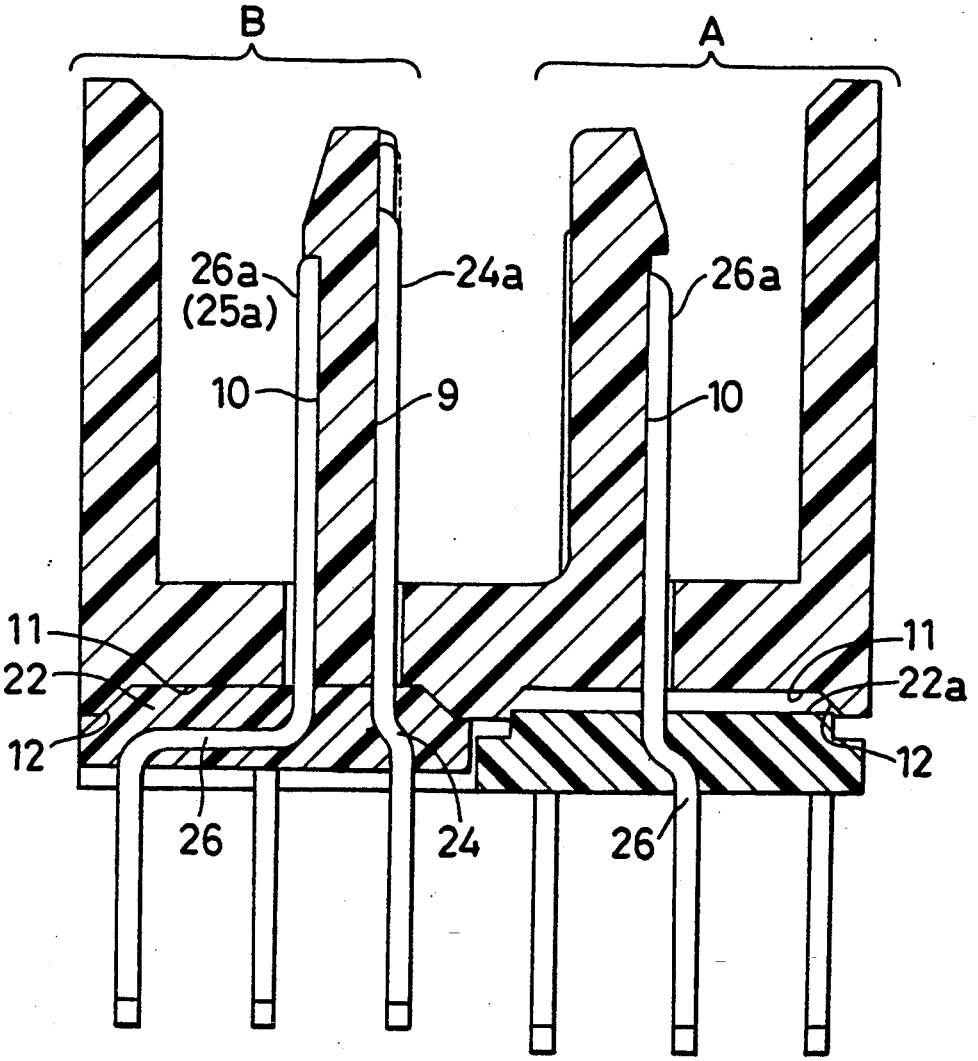
FIG. 14 is a sectional view of the male connector.

In FIG. 14, a terminal unit 21 is placed on each receiving recesses 11 such that the terminal sections 24a, 25a, and 26a of the power terminals 24, ground terminals 25, and signal terminals 26 are put through the terminal apertures 13 and 14 of the housing 4. This condition is illustrated on the right part A, wherein the terminal sections 24a, 25a, and 26a of the power terminals 24, ground terminals 25, and signal terminals 26 are fitted in the receiving channels 9 and 10, respectively, and the front side 22a of the insulation plate 22 is opposed to the receiving recess 11, and the ridges 15 and 16 abut on the front side 22a so that the terminal plate 22 is not fitted in the receiving recess 11.

Then, the terminal plate 22 is fused to the housing 4 by ultrasonic fusion. The periphery of the terminal plate 22 is fused to the sloped side wall 12 while the ridges 15 and 16 are fused to the terminal plate 22 so that the terminal plate 22 is completely fused to the receiving recess 11. This condition is illustrated in the left part B.

Figure 30:
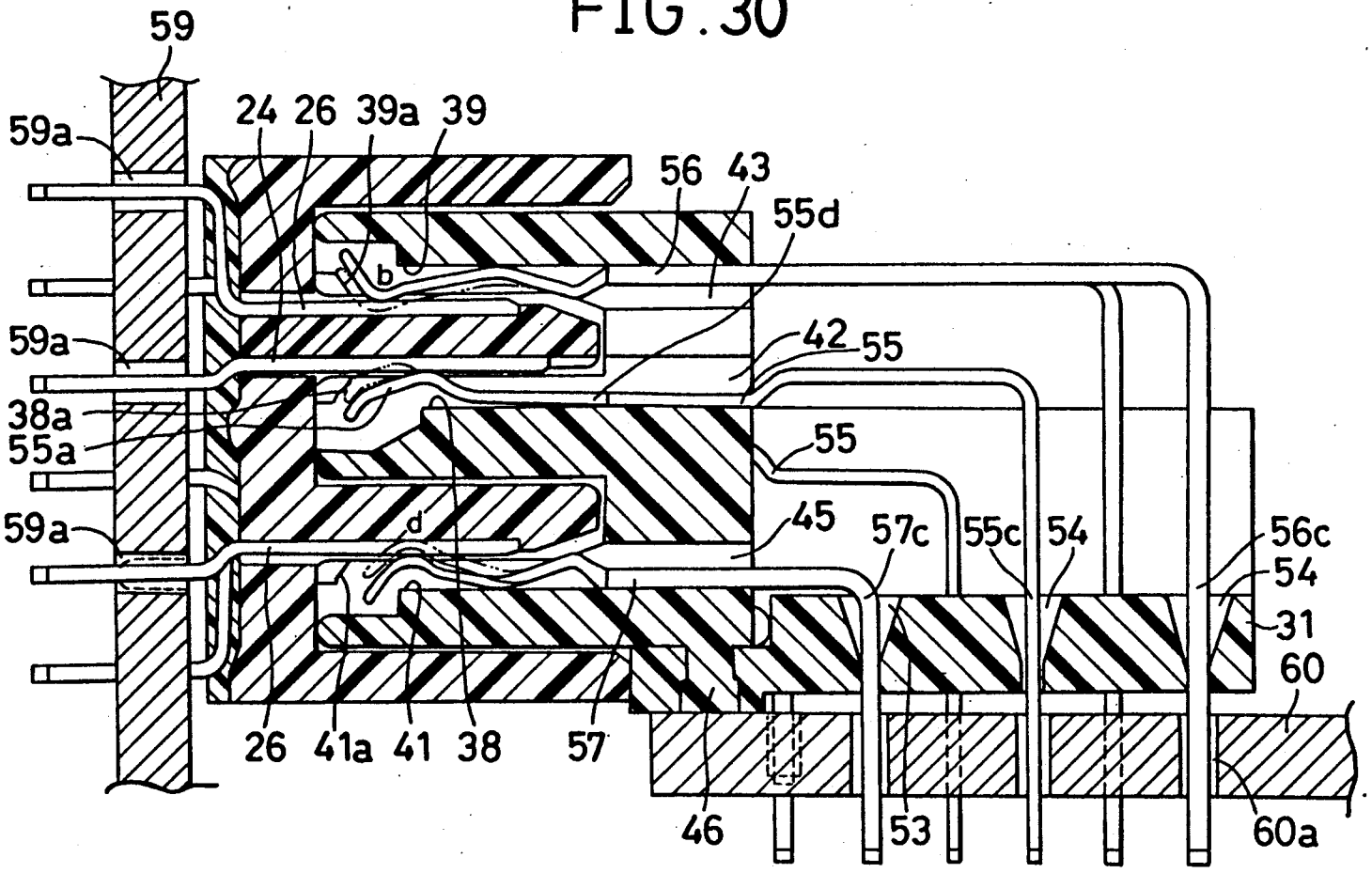
FIG. 30 is a sectional view of the male connector and the female connector under the connected condition.

As FIG. 30 shows, the male connector 2 is mounted on a circuit board 59 by soldering the legs 24a and 26a of the power terminals 24 and signal terminals 26 to the through holes 59a of the circuit board 59.

Figure 15:
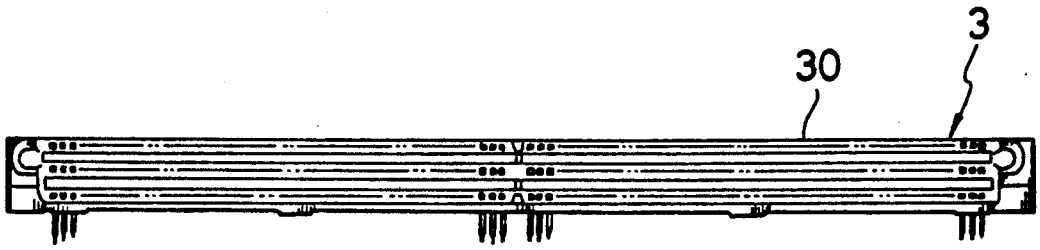
FIG. 15 is a front view of a female connector according to an embodiment of the invention.
Figure 16:
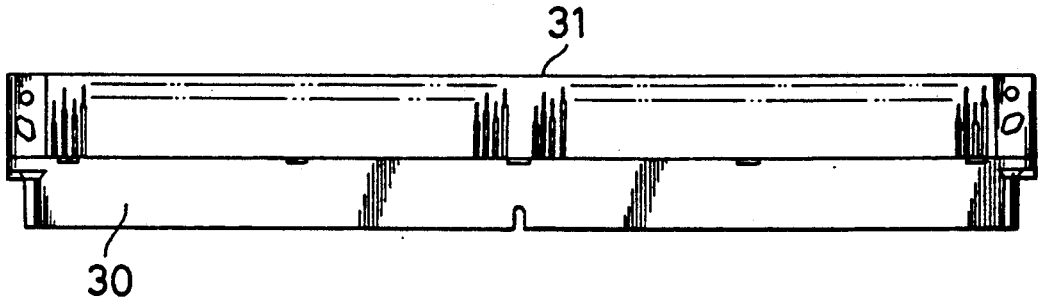
FIG. 16 is a top view of the female connector.
Figure 17:
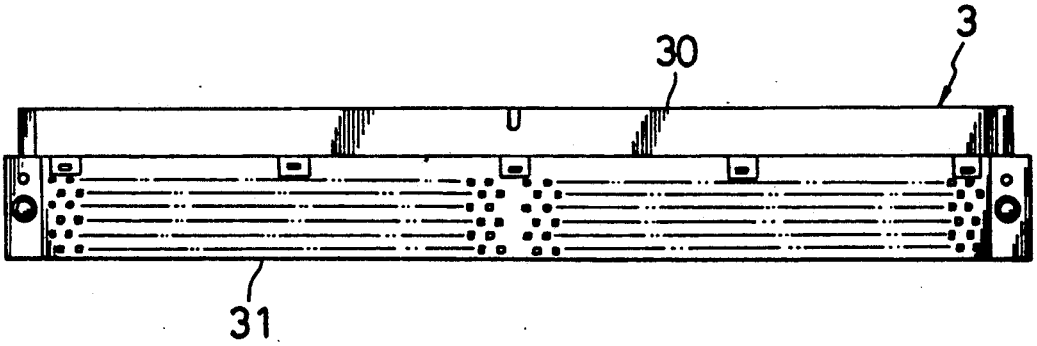
FIG. 17 is a bottom view of the female connector.
Figure 18:
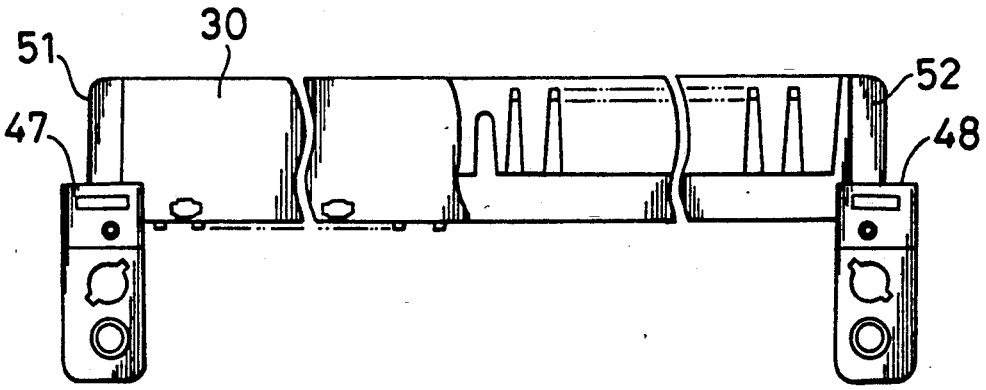
FIG. 18 is a bottom view of a housing of the female connector.
Figure 19:
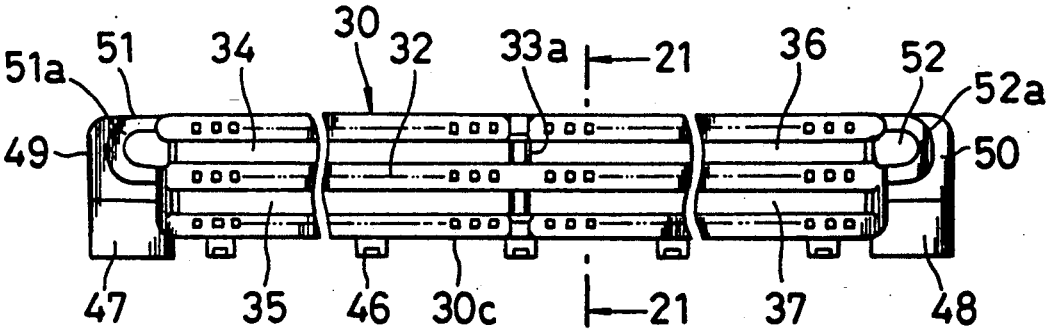
FIG. 19 is a front view of the housing.
Figure 20:
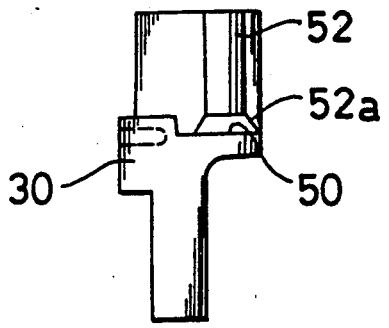
FIG. 20 is a side view of the housing.
Figure 21:
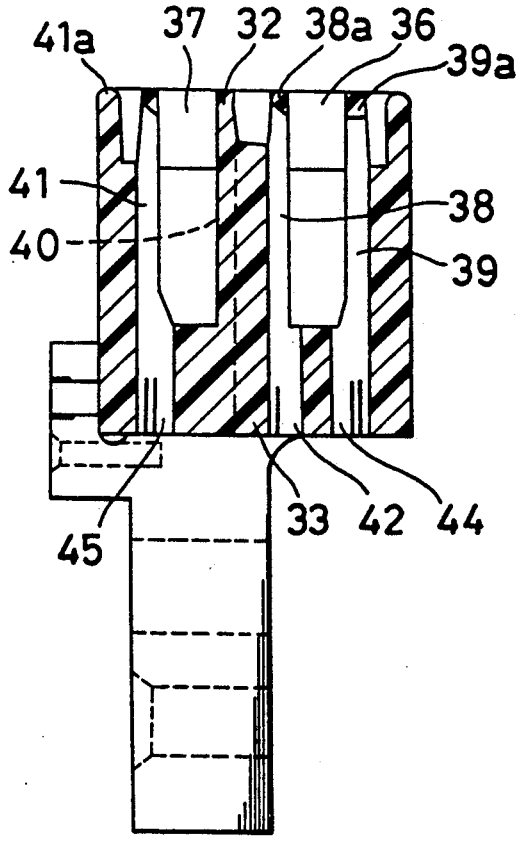
FIG. 21 is a sectional view taken along line 21—21 of FIG. 19.

In FIGS. 15–17, a female connector 3 of the right angle DIP type includes a substantially rectangular housing 30 and a detachable flat locator 31 which is attached to the rectangular housing 30 at right angles.

In FIGS. 18–21, the hollow housing 30 has a central insulation plate 32 extending forwardly from the rear wall 33. A cross rib 33a links the central insulation plate 32 to the housing 30, thus forming four fitting cavities 34, 35, 36, and 37. A number of power terminal receiving channels 38 are formed on one side of the insulation plate 32 at the predetermined pitch while a number of signal terminal receiving apertures 39 are formed on the upper inside of the housing 30 at a half of the predetermined pitch. Similarly, a number of power terminal receiving channels 40 are formed on the other side of the insulation plate 32 at the predetermined pitch but offset by a half of the pitch with respect to the receiving channels 38. A number of signal terminal receiving channels 41 are formed on the lower inside of the housing at a half of the predetermined pitch. Terminal apertures 42, 43, 44, and 45 are formed on the rear wall 33 of the housing 30 so as to communicate with the respective receiving channels 38, 40, 39, and 41.

A number of engaging studs 46 extend downwardly from the bottom 30c of the housing 30. A pair of abutment mounts 47 and 48 are formed on opposite sides of the housing 30. A pair of guide recesses 49 and 50 are formed on the upper portions of the abutment mounts 47 and 48. A pair of guide projections 51 and 52 extend forwardly from the guide recesses 49 and 50 along opposite sides of the housing 30. Each guide projection 51 or 52 has a sloped base portion 51a or 52a for fitting in the tapered portion 20a of the foolproof recess 20. The guide recesses 49 and 50 receive the guide portions 19 of the male connector 2 while the guide projections 51 and 52 are inserted into the foolproof sections 17 and 18.

Figure 22:
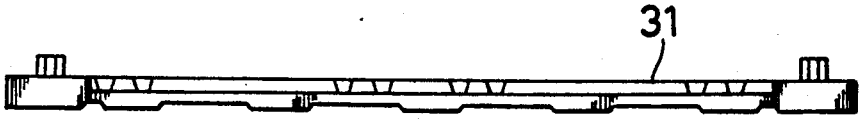
FIG. 22 is a side view of a flat locator of the female connector.
Figure 23:
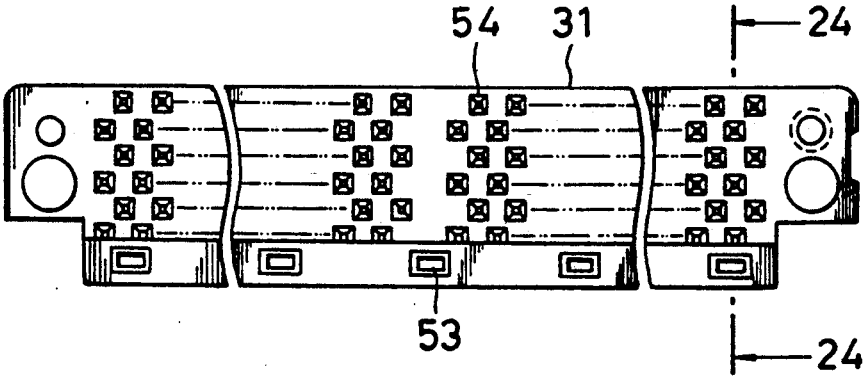
FIG. 23 is a top view of the flat locator.
Figure 24:
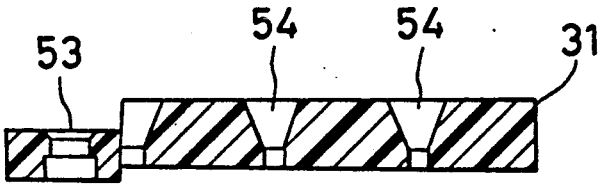
FIG. 24 is a sectional view taken along line 24—24 of FIG. 23.

In FIGS. 22–24, the flat locator 31 has a number of engagement holes 53 on the front stepped-down portion thereof and a number of terminal apertures 54 on the main portion thereof. The flat locator 31 is affixed to the bottom 30c of the housing 30 at right angles by fitting the engagement studs 46 of the housing 30 into the engagement holes 53 thereof (FIG. 30).

Figure 25:
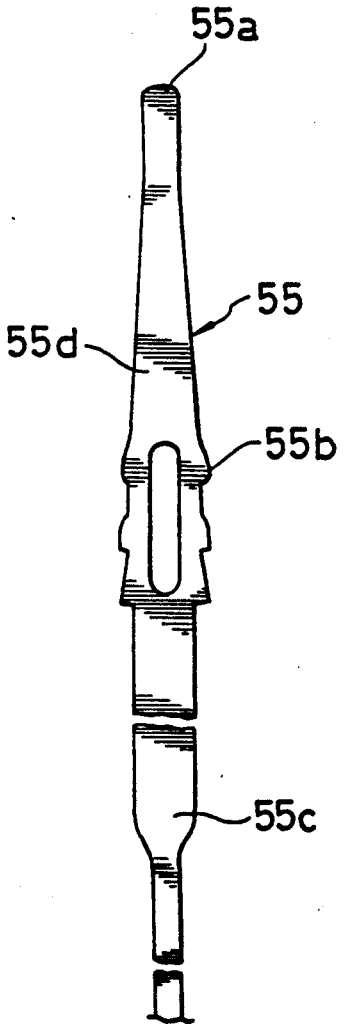
FIG. 25 is a top view of a power terminal according to an embodiment of the invention.
Figure 26:
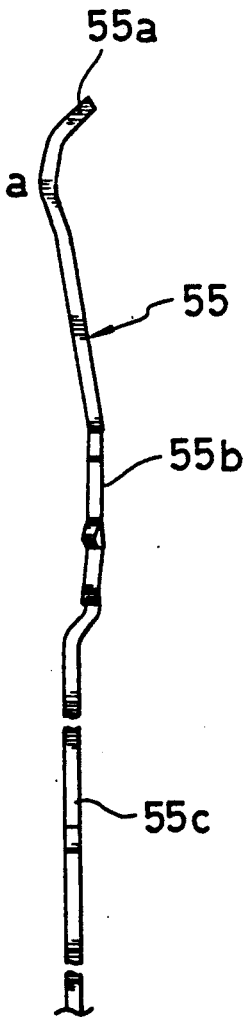
FIG. 26 is a side view of the power terminal.

In FIGS. 25 and 26, a power terminal 55 has a contact portion 55a, a press fit portion 55b, and a leg portion 55c. The section between the press fit portion 55b and the contact portion 55a is curved so as to provide a spring property. The contact portion 55a has a C-shaped cross section and a contact point a on the top.

Figure 27:
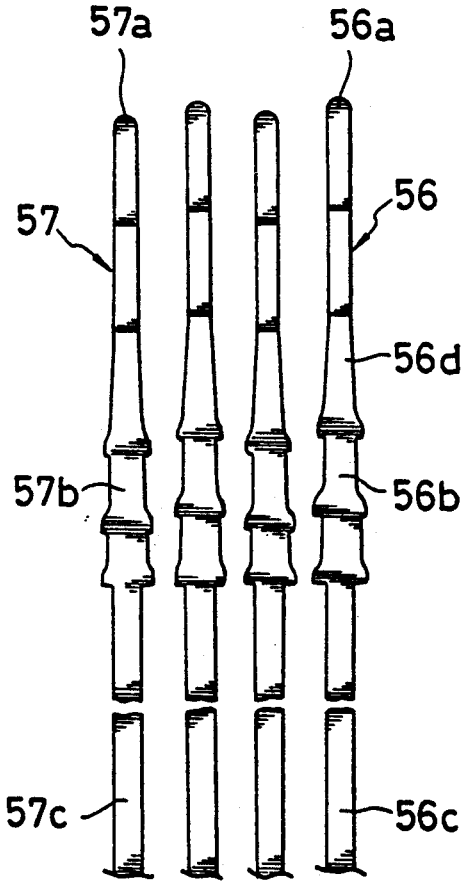
FIG. 27 is a top view of short and tall signal terminals according to an embodiment of the invention.
Figure 28:
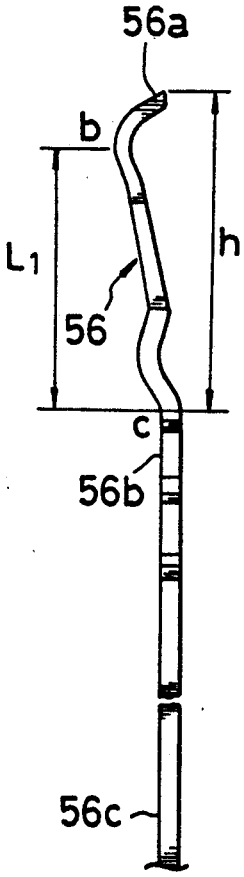
FIG. 28 is a side view of the tall signal terminal.
Figure 29:
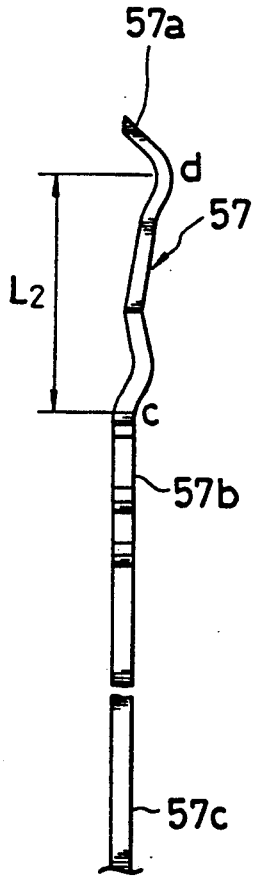
FIG. 29 is a side view of the short signal terminal.

In FIGS. 27–29, there are shown two types of signal terminals. A tall signal terminal 56 has a contact portion 56a, a press fit portion 56b, and a leg portion 56c. The contact portion 56a has a C-shaped cross section and a contact point b on the top. The intermediate section 56d between the contact portion 56a and the press fit portion 56b increases its width toward the press fit portion 56b and has a C-shaped base portion to minimize both the height h of the contact portion 56a and the spring constant.

Similarly, a short signal terminal 57 has a contact portion 57a, a press fit portion 57b, and a leg portion 57c. The contact portion 57a has a C-shaped cross section and a contact point d on the top. The intermediate section 57d between the contact portion 57a and the press fit portion 57b increases its width toward the press fit portion 57b and a C-shaped base portion to minimize both the height h of the contact portion 57a and the spring constant. L2 is made smaller than L1 wherein L1 is the distance between the base point c of the intermediate section 56d and the contact point b and L2 is the distance between the base point c of the intermediate section 57d and the contact point d.

In FIG. 30, the power terminals 55 are put through the terminal apertures 42 of the housing 30 such that the intermediate sections 55d and the contact portions 55a are fitted in the receiving channels 38, with the end portions of the contact portions 55a engaging the hook portions 38a of the receiving channels 38. The leg portions 55c of the power terminal 55 are bent at right angles in middle portions, and the end portions are inserted in the engage holes 54 of the flat locator 31.

Similarly, the signal terminals 56 and 57 are put through the terminal apertures 43 and 45, respectively, such that the intermediate portions 56d and 57d and the contact portions 56a and 57a are fitted in the receiving channels 39 and 41, respectively, with the end portions of the contact portions 56a and 57a engaging the hook portions 39a and 41a of the receiving channels 39 and 41, respectively. The leg portions 56c and 57c of the signal terminals 56 and 57 are bent at right angles in the middle portions, and the end portions are inserted in the engagement apertures 54 of the flat locator 31. Since L1 and L2 are different, the contact points a and b are offset.

The female connector 3 is mounted on a board 60 by soldering the end portions of the leg portions 55c, 56c, and 57c of the power and signal terminals 55, 56, and 57 to the through holes 60a. The male and female connector 2 and 3 are connected so that the power terminals 24 and 55, and the signal terminals 26, 56, and 57 of the male and female connectors 2 and 3 are brought into contact with each other for providing electrical continuity between the two circuit boards 59 and 60.

When the male connector 2 is fitted in the female connector 3, the guide projections 51 and 52 are fitted in the foolproof recesses 20 while the guide portions 19 are fitted in the receiving recesses 50, with the sloped base portions 51a and 52a abutting on the tapered sections 20a of the foolproof recesses 20. Since the guide portions 19 are fitted in the receiving recesses 50, the height of the connector is reduced.

Figure 31:
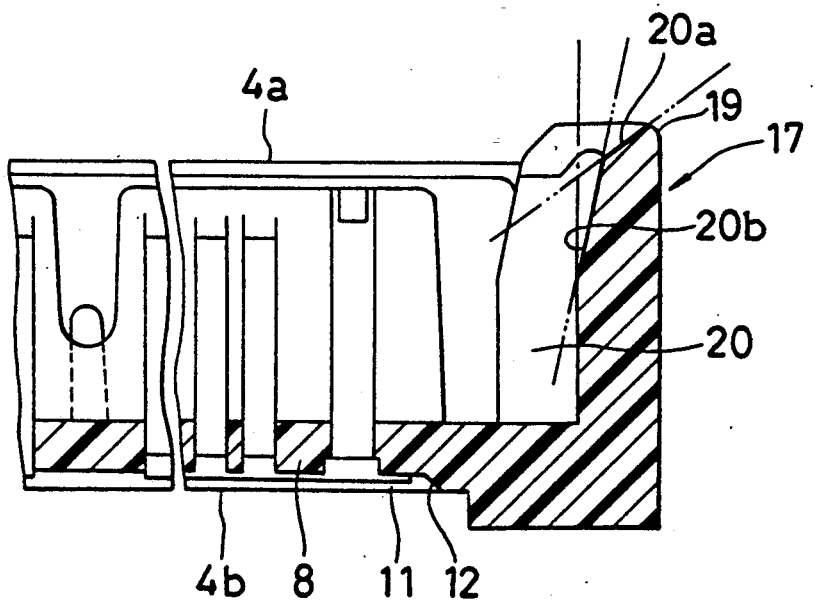
FIG. 31 is a sectional view of the male connector housing similar to FIG. 9.

In FIG. 31, as the male connector 2 is unplugged from the female connector in an oblique way, the left side guide projection 52 is first pulled out of the left side foolproof section 17 but the right side guide projection 51 is pulled out of the foolproof section 17 by sliding first on the side wall of the receiving recess 20, and then the tapered surface 20b and finally the surface of the arching mouth 20a so that no excessive force is applied to the corner of the connector, thus preventing any damage thereto otherwise caused by the forcible oblique unplugging operation.

As has been described above, according to the invention, a number of terminals are attached to the terminal plate 22 to form a terminal unit 21. A plurality of such terminal units 21 are fitted into the receiving recesses 11 of the housing 4, and the terminal plate 22 is fused to the housing 4, thereby providing a super multipole connecter without difficulty. A pair of foolproof sections 17 and 18 are formed on opposite sides of the connector housing 4. The foolproof section has a guide portion 19 raised from the front surface 4a and a foolproof recess 20 extending rearwardly from the guide portion 19. The foolproof recess 20 has an expanded mouth portion 20a having a sloped wall and a tapered section 20b extending rearwardly from the mouth portion. A pair of guide recesses 49 and 50 are formed on opposite sides of the mating connector for receiving the guide portions 19. A pair of guide projections 51 and 52 extend forwardly from the guide recesses for fitting into the foolproof recesses 20. When one connector is plugged into the other, the guide projections 51 and 52 are inserted into the foolproof recesses 20 while the guide portions 19 are fitted into the guide recesses 49 and 50, with the sloped sections 51 and 52 abutting on the tapered sections 20b. Thus, the height of the connector is reduced.

When one connector is plugged out of the other in an oblique way, one of the guide projections 51 is first pulled out of the corresponding foolproof recess 20, but the other guide projection 52 slides first on the tapered section 20b and then the sloped mouth portion 20a, thereby prevent any damage otherwise caused by the forcible oblique unplugging operation.

I claim:

1. A super multipole electrical connector consisting of a male connector and a female connector, said male connector comprising:

a housing having a fitting cavity opening on a front side thereof and at least one terminal unit receiving recess on a rear side thereof;

a terminal plate;

a plurality of terminals planted on said terminal plate to form a terminal unit;

said terminal unit being fitted in said receiving recess and secured to said housing to form a super multipole electrical connector;

a pair of foolproof sections formed on opposite sides of said housing, said foolproof sections each comprising:

a guide portion raised from said front side of said housing;

a foolproof recess extending rearwardly from said guide portion and having an expanded arcking mouth portion at a front end thereof, said arcking mouth portion having a outwardly sloped side wall, a tapered section extending rearwardly from said mouth portion; said female connector comprising:

a housing having a pair of guide recesses on opposite sides thereof for receiving said guide portions and a pair of guide projections extending forwardly from said guide recesses for fitting into said foolproof recesses.

* * * * *